US009331439B2

(12) United States Patent
Qian et al.

(10) Patent No.: US 9,331,439 B2
(45) Date of Patent: May 3, 2016

(54) ELECTRICAL CONNECTOR ASSEMBLY HAVING SIMPLIFIED RECEPTACLE TERMINALS

(71) Applicant: HON HAI PRECISION INDUSTRY CO., LTD., New Taipei (TW)

(72) Inventors: Qiu Qian, Kunshan (CN); Jian-Kuang Zhu, Kunshan (CN); Chun-Sheng Li, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 56 days.

(21) Appl. No.: 14/273,561

(22) Filed: May 9, 2014

(65) Prior Publication Data

US 2014/0335733 A1 Nov. 13, 2014

(30) Foreign Application Priority Data

May 9, 2013 (CN) ..... 2013 2 2476066 U

(51) Int. Cl.
*H01R 24/00* (2011.01)
*H01R 24/60* (2011.01)
*H01R 107/00* (2006.01)

(52) U.S. Cl.
CPC ..... *H01R 24/60* (2013.01); *H01R 2107/00* (2013.01)

(58) Field of Classification Search
CPC ..... H01R 23/725; H01R 12/57; H01R 29/00; H01R 13/2442; H01R 23/7073
USPC ..... 439/74, 83, 189, 626, 660, 862, 682
See application file for complete search history.

(56) References Cited

U.S. PATENT DOCUMENTS 4,155,612 A * 5/1979 Silverio ..... H05K 7/1092 439/189
5,145,386 A * 9/1992 Berg ..... H01R 12/778 439/682
5,188,535 A * 2/1993 Bertho ..... H01R 12/57 439/682
5,938,456 A * 8/1999 Kozel ..... H01R 13/41 439/733.1
6,068,519 A * 5/2000 Lok ..... H01R 13/506 439/660
7,384,288 B2 * 6/2008 Sano ..... H01R 23/688 439/189
7,527,529 B2 * 5/2009 Ho ..... H01R 12/57 439/660
8,192,217 B2 * 6/2012 Zhu ..... H01R 12/716 739/284
8,246,360 B1 * 8/2012 Tsai ..... H01R 12/55 439/66
8,342,890 B2 * 1/2013 Zhu ..... H01R 12/716 439/682
8,647,153 B2 * 2/2014 Ju ..... H01R 12/714 439/626
8,899,997 B2 * 12/2014 Zhang ..... H01R 12/57 439/83
9,039,453 B2 * 5/2015 Song ..... H01P 1/00 439/626
2012/0142221 A1 6/2012 Naskali

* cited by examiner

*Primary Examiner* — Thanh Tam Le
(74) *Attorney, Agent, or Firm* — Wei Te Chung; Ming Chieh Chang

(57) ABSTRACT

An electrical connector assembly includes an receptacle connector, the receptacle connector includes a first insulative housing defining a mating surface and a first side surface extending along a first direction. A plurality of first terminals are retained in the first insulative housing and each defines a contacting plate fixed to the first insulative housing and a welding portion extending outside of the first insulative housing. The first insulative housing defines a plurality of mating holes running through the mating surface, a part of the contacting plate is exposed in the mating hole to form a contacting portion.

8 Claims, 5 Drawing Sheets

ELECTRICAL CONNECTOR ASSEMBLY HAVING SIMPLIFIED RECEPTACLE TERMINALS

BACKGROUND OF THE INVENTION

1. Field of the Invention

The present invention relates to an electrical connector assembly, and more particularly to an electrical connector assembly having a plurality of simplified receptacle terminals.

2. Description of the Related Art

In the prior art, spring terminal connector assembly includes plug connector and receptacle connector mating with each other. The plug connector includes a plug housing and a plurality of spring terminals attached to the plug housing, and the receptacle connector includes a receptacle housing and a plurality of receptacle terminals retained in the receptacle housing. The spring terminal is generally processed to a shape corresponding to the spring terminal and assembled into the receptacle housing to math the spring terminal of the plug connector. However, the design of the connector assembly should spend high cost and have low productivity.

Therefore, an improved electrical connector assembly is highly desired to meet overcome the requirement.

BRIEF SUMMARY OF THE INVENTION

An object of the present invention is to provide an electrical connector assembly having a plurality of simplified receptacle terminals easily to be assembled.

In order to achieve above-mentioned object, an electrical connector assembly includes an receptacle connector, the receptacle connector includes a first insulative housing defining a mating surface and a first side surface extending along a first direction. A plurality of first terminals are retained in the first insulative housing and each defines a contacting plate fixed to the first insulative housing and a welding portion extending outside of the first insulative housing. The first insulative housing defines a plurality of mating holes running through the mating surface, a part of the contacting plate is exposed in the mating hole to form a contacting portion.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
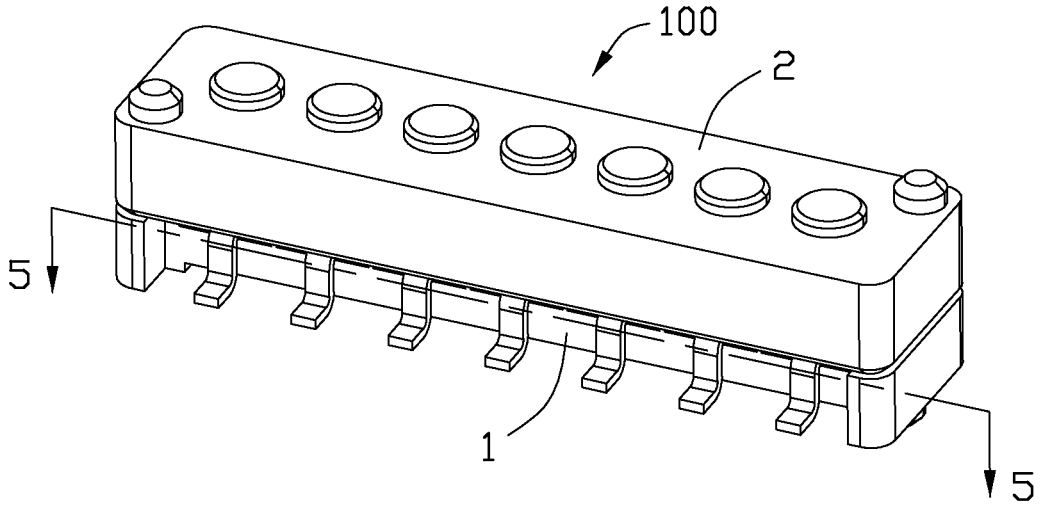
FIG. 1 is a perspective view of an electrical connector assembly in accordance with the present invention.

Reference will now be made to the drawing figures to describe a preferred embodiment of the present invention in detail. Referring to FIG. 1, an electrical connector assembly

100 in accordance with the present invention includes a receptacle connector 1 and a plug connector 2 mating with each other.

Figure 2:
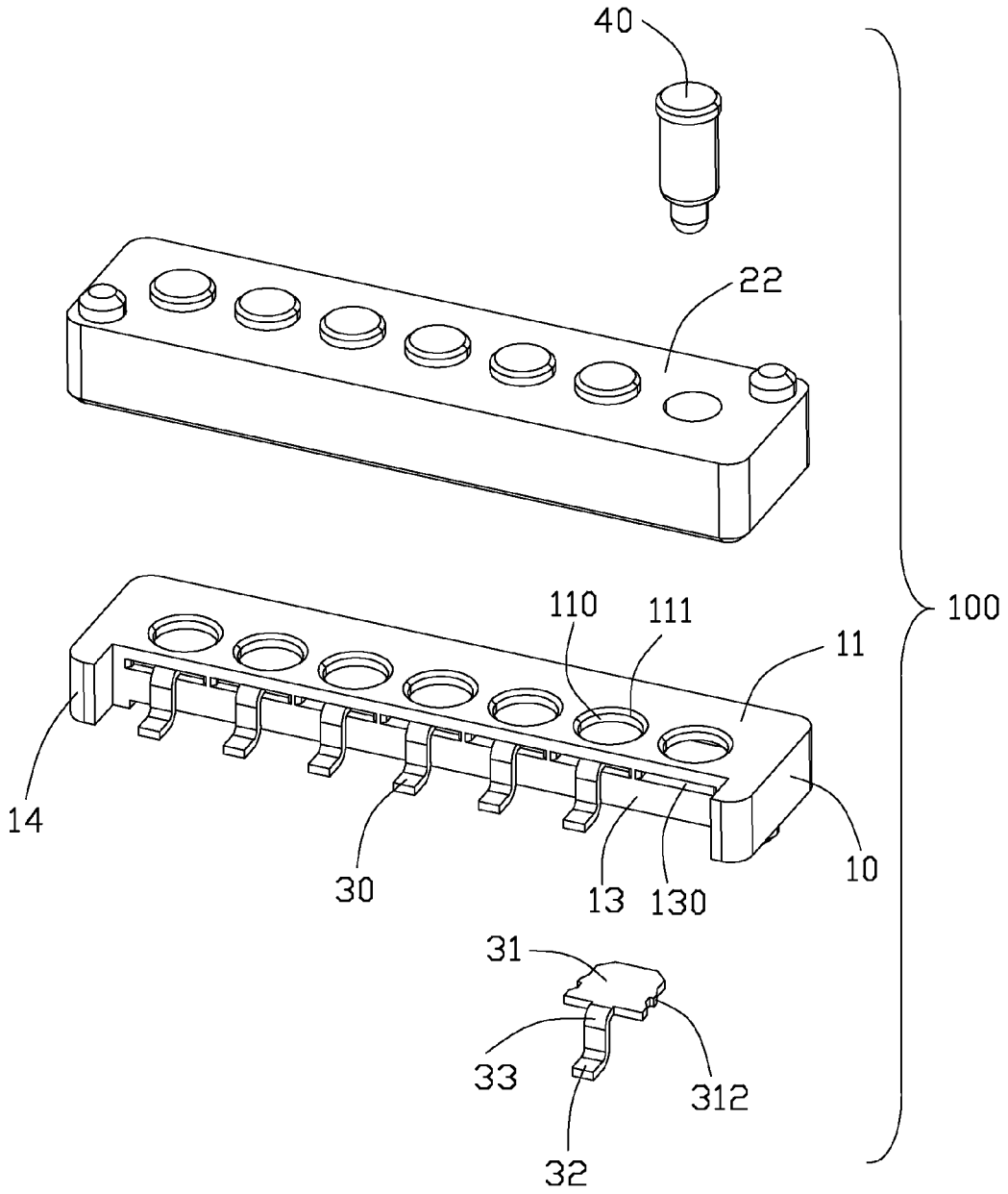
FIG. 2 is an exploded perspective view of the electrical connector assembly shown in FIG. 1.
Figure 3:
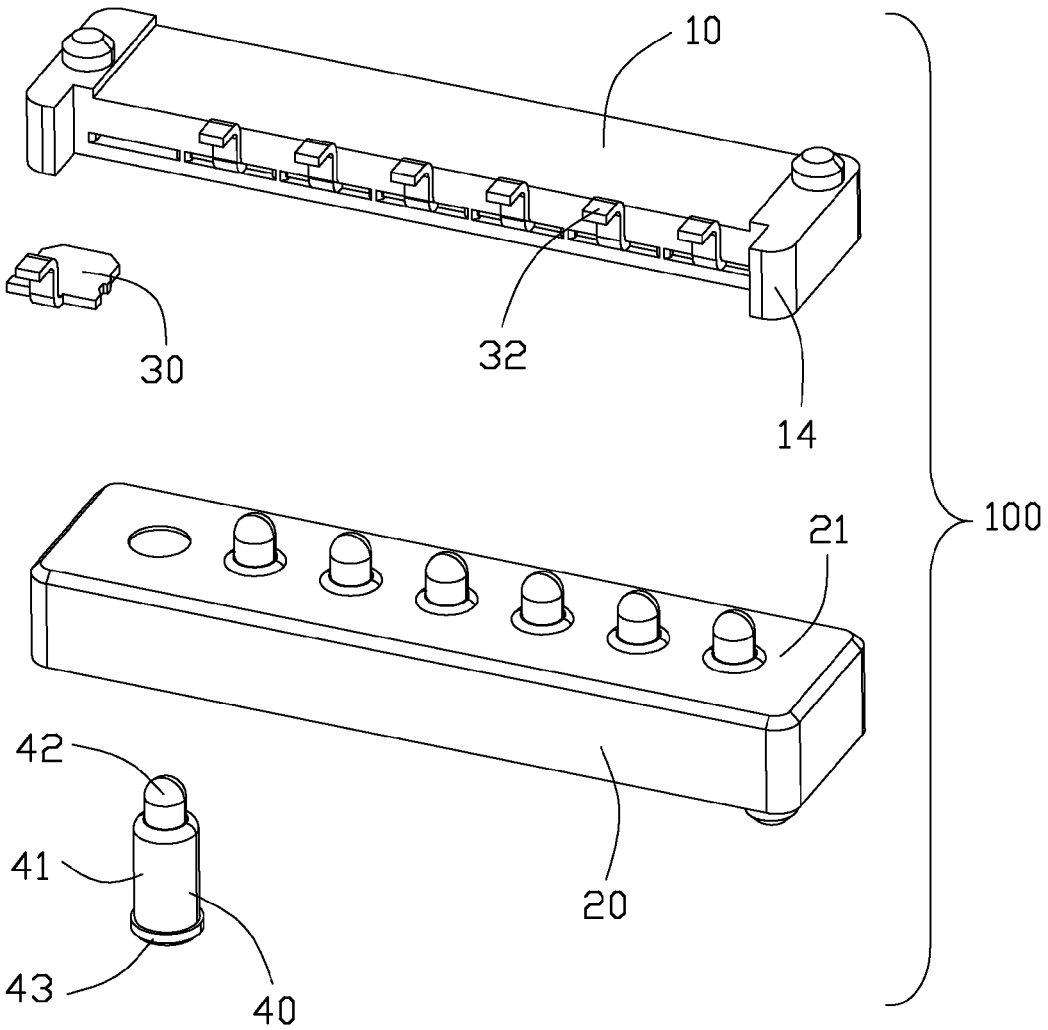
FIG. 3 is another exploded perspective view of the electrical connector assembly shown in FIG. 1.

Referring to FIG. 2 and FIG. 3, the receptacle connector 1 includes a first insulative housing 10 extending along a longitudinal direction and a plurality of first terminals 30 inserted in the first insulative housing 10 and arranged along the longitudinal direction, wherein the longitudinal direction is defined as a first direction and a transverse direction perpendicular to the longitudinal direction is defined as a second direction. The first insulative housing 10 defines a mating surface 11, a first side surface 13 located on a lateral side of the mating surface 11 and a plurality of circular mating holes 110 running through the mating surface 11. The mating hole 110 defines a horn-shaped guiding edge 111 adjacent to the mating surface 11 and used for guiding the plug connector 2 inserted thereto. Each first terminal defines a contacting plate 31 fixed in the first insulative housing 10, a welding portion 32 extending outside of the first insulative housing 10 and a connecting portion 33 connecting the contacting plate 31 and the welding portion 32. The contacting plate 31 is disposed in the first insulative housing 10 with a part exposed in the mating hole 110 to be defined as a contacting portion, the connecting portion 33 and the welding portion 32 extend along the second direction.

Figure 4:
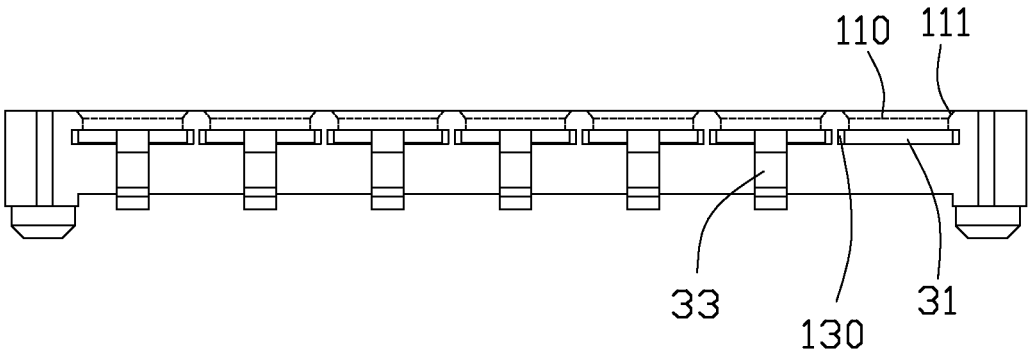
FIG. 4 is a front view of a receptacle connector of the electrical connector assembly shown in FIG. 1.
Figure 5:
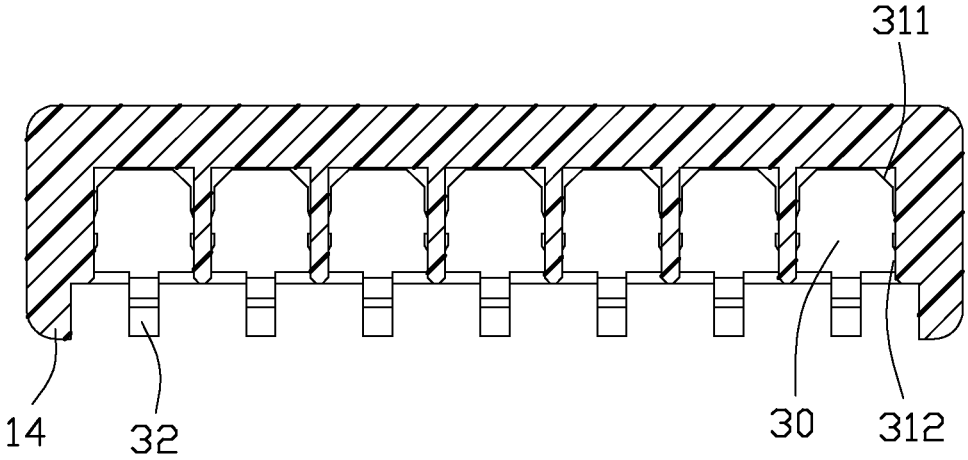
FIG. 5 is a cross-section view of the electrical connector assembly taken along line 5-5 of FIG. 1.

Referring to FIG. 4 to FIG. 5, the first insulative housing 10 defines a plurality of terminal slots 130 running through the first side surface 13 and a pair of protecting ribs 14 located on opposite sides of the first side surface 13 and extending along the second direction. The plurality of terminal slots 130 are arranged along the first direction and flush with each other, the width of the terminal slot 130 is greater than the diameter of the mating hole 110 in the first direction. The plurality of contacting plates 31 are inserted in corresponding terminal slots 130 and each contacting plate 31 defines a pair of guiding edges 311 and at least a pair of barbs 312 located on both sides of the contacting plate 31 in the second direction, the guiding edge 311 is used for guiding the contacting plate 31 to be inserted into the terminal slot 130 and the barb 312 makes it easy to fix the contacting 31 to the terminal slot 130. The contacting plate 31 is lower than the mating surface 110 in a third direction perpendicular to both the first direction and the second direction which means that the contacting surface of the contacting plate 31 close in the bottom of the mating holes 110. The pair of protecting ribs 14 locate on both sides of the welding portions 32 of the first terminals to prevent the welding portions of the first terminals from being damaged by improper operation.

Referring to FIG. 2 and FIG. 3, the plug connector 2 includes a second insulative housing 20 extending along the first direction and a plurality of second terminals 40 attached to the second insulative housing 20, the second insulative housing 20 defines an abutting surface 21 and a mounting surface opposite to each other. The second terminals 40 are elastic terminals and extend outside of the abutting surface 21 of the second insulative housing 20, each second terminal 40 defines a tubular main portion 41, a contacting portion 42 elasticity moving back-and-forth relative to the main portion 41 in the third direction and a soldering portion 43 located on the end of the main portion 41. The contacting portion 42 of the second terminal projects outside of the mating surface 21 of the second insulative housing 20 and the soldering portion 43 extends outside of the mounting surface 22 of the second insulative housing 20.

when the plug connector 2 mates with the receptacle connector 1, the second terminals 40 of the plug connector 2 are guided into the mating holes 110 of the receptacle connector 1 via the guiding edges 111 of the mating holes 110 so as to elastically and electrically connect the contacting portions of the first terminals 30 of the receptacle connector 1. It makes the connector assembly achieving electrically conduction while reduces the production and processing steps of the connector, thereby improving the productivity of the connector and reducing the manufacturing cost of the connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector assembly comprising:

a first connector including a first insulative housing defining a plurality of first passageways along a transverse direction while each of said first passageways extending along a vertical direction perpendicular to said transverse direction;

a plurality of first contacts disposed in the corresponding passageways, respectively, each of said first contacts defining a cylindrical body with a retractable head;

a second connector including a second insulative housing defining a plurality of second passageways extending along the vertical direction with corresponding openings communicating with an exterior, each of said openings being dimensioned corresponding to a diameter of the corresponding first contact which is adapted to be inserted into the corresponding second passageway;

a plurality of horizontal slots formed in the second housing and intersected with the corresponding second passageways, respectively, each of said slots defining a height in the vertical direction and a width in the transverse direction; and a plurality of second contacts assembled to the second housing; wherein each of said second contacts includes a horizontal contacting plate inserted into the corresponding slot and having dimensions in compliance with said height and said width so as to have the head of the first contact abut against the contacting plate of the corresponding second contact during mating; wherein each of said passageways is downwardly terminated at the corresponding horizontal slot so as to have the contacting plate of the corresponding second contact fully upwardly supported by the second housing wherein each of said second contacts further includes a horizontal solder tail exposed outside of a side face of the second housing in a lateral direction perpendicular to both said vertical direction and said transverse direction; and wherein said second housing further includes a pair of protecting ribs at two opposite ends in said transverse direction, and said pair of protecting ribs extend in said lateral direction to protect the solder tails therebetween in the transverse direction.

2. The electrical connector assembly as claimed in claim 1, wherein the first contact defines an expanded bottom flange upwardly abutting against a bottom surface of the first housing in the vertical direction.

3. The electrical connector as claimed in claim 1, wherein each of said horizontal slots extends through a corresponding side face of the second housing to communicate with the exterior in a lateral direction perpendicular to both said vertical direction and said transverse direction.

4. the electrical connector as claimed in claim 1, wherein the horizontal contacting plate fully occupies the corresponding horizontal slot in both the height and the width.

5. The electrical connector as claimed in claim 4, wherein the horizontal contacting plate further fully occupies the corresponding horizontal slot in a length along a lateral direction perpendicular to both said transverse direction and said vertical direction.

6. An electrical connector comprising:

an insulative housing defining a plurality of passageways arranged along a transverse direction and each extending along a vertical direction, which is perpendicular to said transverse direction, with corresponding openings upwardly communicating with an exterior;

a plurality of horizontal slots formed in the housing and intersected with the corresponding passageways, respectively, each of said slots defining a height in the vertical direction and a width in the transverse direction; and a plurality of contacts assembled to the housing; wherein each of said contacts includes a horizontal contacting plate inserted into the corresponding slot and having dimensions in compliance with said height and said width; wherein each of said passageways is downwardly terminated at the corresponding horizontal slot so as to have the contacting plate of the corresponding contact upwardly fully supported by the housing wherein each of said contacts further includes a horizontal solder tail exposed outside of a side face of the housing in a lateral direction perpendicular to both said vertical direction and said transverse direction; and wherein said housing further includes a pair of protecting ribs at two opposite ends in said transverse direction, and said pair of protecting ribs extend in said lateral direction to protect the solder tails therebetween in the transverse direction.

7. The electrical connector as claimed in claim 6, wherein the horizontal contacting plate fully occupies the corresponding horizontal slot in both the height and the width.

8. The electrical connector as claimed in claim 7, wherein the horizontal contacting plate further fully occupies the corresponding horizontal slot in a length along a lateral direction perpendicular to both said transverse direction and said vertical direction.

* * * * *